US009812784B2

(12) United States Patent
Park et al.

(10) Patent No.: US 9,812,784 B2
(45) Date of Patent: Nov. 7, 2017

(54) PLANAR HORN ARRAY ANTENNA

(71) Applicant: WIWORLD CO., LTD, Daejeon (KR)

(72) Inventors: Chan Goo Park, Daejeon (KR); Jun Hee Lee, Chungcheongbuk-do (KR)

(73) Assignee: WIWORLD CO., LTD, Daejeon (KR)

( * ) Notice: Subject to any disclaimer, the term of this patent is extended or adjusted under 35 U.S.C. 154(b) by 0 days.

(21) Appl. No.: 14/767,562

(22) PCT Filed: Feb. 18, 2014

(86) PCT No.: PCT/KR2014/001297

§ 371 (c)(1),
(2) Date: Aug. 12, 2015

(87) PCT Pub. No.: WO2014/129782

PCT Pub. Date: Aug. 28, 2014

(65) Prior Publication Data

US 2016/0020519 A1 Jan. 21, 2016

(30) Foreign Application Priority Data

Feb. 20, 2013 (KR) ..... 10-2013-0018327

(51) Int. Cl.

| | |
|---|---|
| ***H01Q 13/02*** | (2006.01) |
| ***H01Q 15/24*** | (2006.01) |
| ***H01Q 19/08*** | (2006.01) |
| ***H01Q 21/00*** | (2006.01) |

(52) U.S. Cl.
CPC ..... *H01Q 13/02* (2013.01); *H01Q 15/24* (2013.01); *H01Q 19/08* (2013.01); *H01Q 21/0037* (2013.01)

(58) Field of Classification Search
CPC ..... H01Q 13/02; H01Q 15/24; H01Q 19/08; H01Q 21/0037
USPC ..... 343/756, 786, 909
See application file for complete search history.

(56) References Cited

U.S. PATENT DOCUMENTS

| | | | | |
|---|---|---|---|---|
| 3,680,142 | A * | 7/1972 | Van Atta | H01Q 21/24 343/770 |
| 5,515,059 | A * | 5/1996 | How | H01Q 3/44 342/372 |
| 2008/0316124 | A1* | 12/2008 | Hook | H01Q 1/286 343/705 |

(Continued)

FOREIGN PATENT DOCUMENTS

| | | | |
|---|---|---|---|
| KR | 1020050103608 | A | 11/2005 |
| KR | 1020060096880 | A | 9/2006 |

(Continued)

OTHER PUBLICATIONS

ISA Korean Intellectual Property Office, International Search Report Issued in Application No. PCT/KR2014/001297, dated Apr. 22, 2014, WIPO, 4 pages.

*Primary Examiner* — Dameon E Levi
*Assistant Examiner* — David Lotter
(74) *Attorney, Agent, or Firm* — McCoy Russell LLP

(57) ABSTRACT

Provided is a planar horn array antenna includes: a waveguide part; a horn part having one side connected to the waveguide part and the other side formed with an opening for guiding a radio wave incident or emitted thereto; and a radio wave guide part having a dividing member coupled with the opening and consisting of circular dividing holes arranged in a matrix of n×n.

5 Claims, 10 Drawing Sheets

(56) References Cited

U.S. PATENT DOCUMENTS

| | | | | |
|---|---|---|---|---|
| 2010/0231475 | A1* | 9/2010 | Ou | H01Q 13/0258 343/776 |
| 2011/0140980 | A1* | 6/2011 | Kim | H01Q 19/08 343/781 R |
| 2012/0086618 | A1* | 4/2012 | Huang | H01Q 19/08 343/786 |
| 2012/0218160 | A1* | 8/2012 | Montgomery | H01Q 13/0275 343/776 |
| 2013/0120205 | A1* | 5/2013 | Thomson | H01Q 21/0075 343/776 |

FOREIGN PATENT DOCUMENTS

| | | | |
|---|---|---|---|
| KR | 1020060100026 | A | 9/2006 |
| KR | 20080105856 | A | 12/2008 |

* cited by examiner

PLANAR HORN ARRAY ANTENNA

CROSS REFERENCE TO RELATED APPLICATIONS

The present application is a U.S. National Phase of International Patent Application Serial No. PCT/KR2014/001297, entitled "PLANAR HORN ARRAY ANTENNA," filed on Feb. 18, 2014, which claims priority to Korean Patent Application No. 10-2013-0018327, entitled "PLANAR HORN ARRAY ANTENNA," filed on Feb. 20, 2013, the entire contents of each of which are hereby incorporated by reference for all purposes.

TECHNICAL FIELD

The present invention relates to a planar horn array antenna.

BACKGROUND ART

Generally, an antenna is to radiate a radio wave to a free space or receive the radio wave. The antenna may be generally classified into a linear antenna, an aperture antenna, a micro strip antenna, a planar horn array antenna, a reflector antenna, a lens antenna, etc., based on various classification standards.

The radio wave radiated from the antenna has a predetermined pattern. Here, a polarization of the radiated radio wave is classified into a linear polarization, a circular polarization, an elliptical polarization, etc., depending on a direction in which an electric field or a magnetic field vibrates and a direction in which a wave proceeds.

In this case, the circular polarization among the polarizations of the radio wave radiated from the antenna is a radio wave in which a locus of a vector end representing a magnitude and a direction of the electric field draws a circle on a plane vertical to the radio wave direction. Generally, the circular polarization may be divided into two linear polarization components which have the same amplitude, polarization planes orthogonal to each other, and different phases by 90°. However, when the amplitudes of the two linear polarization components are different from each other, a composite wave draws an elliptical shape on the plane vertical to the radio wave direction, which is called an elliptical polarization. Meanwhile, in the circular polarization or the elliptical polarization, clockwise rotating the electric field vector of the plane vertical to the radio wave direction toward the radio wave direction is called a clockwise elliptical polarization and counterclockwise rotating the electric field vector of the plane vertical to the radio wave direction toward the radio wave direction is called a counterclockwise elliptical polarization.

The planar horn array antenna means an antenna having a lot of antenna elements arranged therein to control a phase of an excitation current of each element and form a main beam having a by allowing an antennal to have a specific direction and the same phase and is mainly used as an automatic directional antenna for a satellite, etc.

However, a plurality of communication satellites are densely arranged above the equator now, and therefore signal interference occurs between adjacent communication satellites even when the signals from the planar horn array antenna are transmitted to the preset communication satellites.

To solve the above problems, a method for reducing a signal output level of the planar horn array antenna and allocating more frequencies thereto has been used. However, the method has a problem in that a transmission speed of the signal from the planar horn array antenna may be reduced and a rental fee of the communication satellite may be increased.

FIG. 1 is a graph illustrating a beam pattern of a typical planar horn array antenna.

As illustrated in FIG. 1, upon designing the typical planar horn array antenna, an array interval of each element needs to be equal to or more than $\lambda/2$ due to a problem of a conduit interference in the antenna. When the array interval of the elements is equal to or more than $\lambda/2$, there is a problem in that a grating lobe (GL) occurs. A beam pattern of the radio wave is beyond an off-axis mask (OAM) to cause interference between the adjacent communication satellites.

To solve the above problems, Korean Patent Laid-Open Publication No. 2008-0105856 discloses a dual linear polarization horn array antenna, which may reduce a size of the antenna but may not solve the grating lobe occurring from the planar horn array antenna.

Further, the planar horn array antenna has elevation angles and skew angles changed depending on locations and therefore products and specifications of the planar horn array antenna need to be determined in consideration of the skew angles and the elevation angles of each location.

The skew angle means a difference between a receiving angle of a low noise blockdown converter (LNB) and a transmitting angle of a satellite and is also changed depending on the location since the earth is round.

For example, a latitude and a longitude of Perth city which is the western district of Australia each are 31° S and 115° E and a latitude and a longitude of Canberra of the eastern district which is a capital of Australia are 35° S and 149° E. Upon calculating each skew, Perth city has a skew angle of −50° and Canberra has a skew angle of −15°, and therefore the difference in the skew angle therebetween is considerably large.

Therefore, to overcome the difference in the skew angle on each location, the planar horn array antenna needs to control the skew angle as needed. However, for the planar horn array antenna to control the skew angle, the planar horn array antenna needs to mechanically rotate, which leads to a problem in that the planar horn array antenna is complicated, takes up much space, and has reduced accuracy.

DISCLOSURE

Technical Problem

An object of the present invention is to provide a planar horn array antenna capable of minimizing occurrence of a grating lobe.

Another object of the present invention is to provide a plate type antenna without mechanically rotating.

Technical Solution

In one general aspect, a planar horn array antenna includes: a waveguide part 100; a horn part 200 having one side connected to the waveguide part 100 and the other side formed with an opening 201 for guiding a radio wave incident or emitted thereto; and a radio wave guide part 300 having a dividing member 310 coupled with the opening 201 and consisting of circular dividing holes 311 arranged in a matrix of n×n.

In the dividing member 310, when a wavelength of the radio wave incident or emitted to the dividing hole 311 is λ, an inner diameter of the dividing hole 311 may be formed to be 1λ or less.

In the dividing member 310, the dividing hole 311' may be formed in an elliptical shape.

The radio wave guide part 300 may further include a cover member 320 coupled between the opening 201 and the dividing member 310.

In the cover member 320, when a wavelength of the radio wave incident or emitted to the dividing hole 311 is λ, a thickness of the cover member 320 between the opening 201 and the dividing member 310 may be formed to be equal to or less than λ/2.

The radio wave guide part 300 may further include a polarizer member 330 which is disposed in the dividing hole 311 and may be coupled with the cover member 320 to control an angle of the radio wave incident or emitted to the dividing hole 311.

The polarizer member 330 may be formed in an H shape, a cross shape, or a comb shape.

Advantageous Effects

As set forth above, according to the exemplary embodiments of the present invention, the planar horn array antenna includes: the waveguide part; the horn part having one side connected to the waveguide part and the other side formed with the opening for guiding the radio wave incident or emitted thereto; and the radio wave guide part having the dividing member coupled with the opening and consisting of the circular dividing holes arranged in the matrix of n×n, such that the radio wave incident or emitted to the opening may be divided into n×n by the dividing holes to minimize the occurrence of the grating lobe.

Further, according to the exemplary embodiments of the present invention, the planar horn array antenna may further include the polarizer members which are disposed in the dividing holes and coupled with the cover member to control the angle of the radio wave incident or emitted to the dividing holes, whereby the planar horn array antenna may control the skew angle without mechanically rotating.

BEST MODE

Hereinafter, a technical spirit of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

Figure 1:
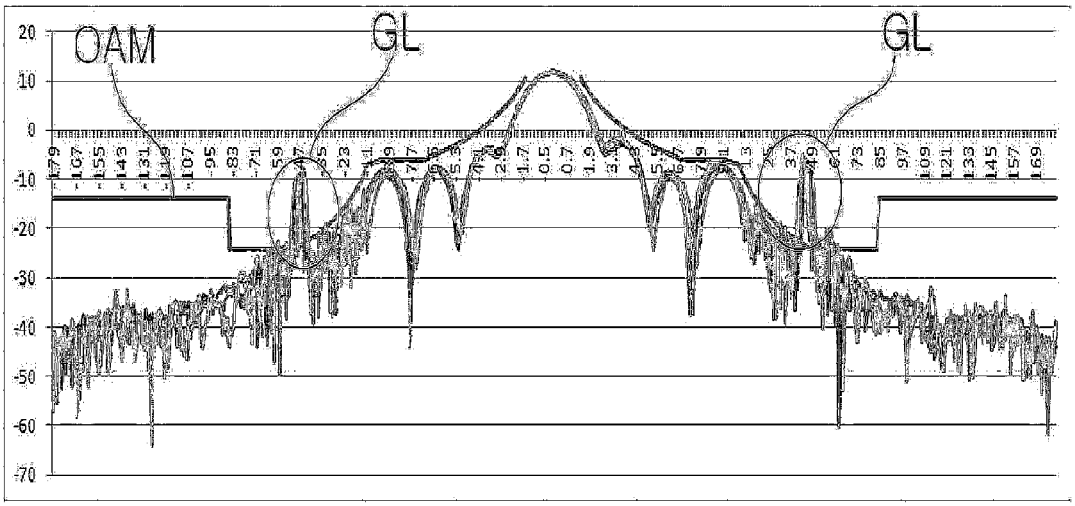
FIG. 1 is a graph illustrating a beam pattern of a typical planar horn array antenna.
Figure 2:
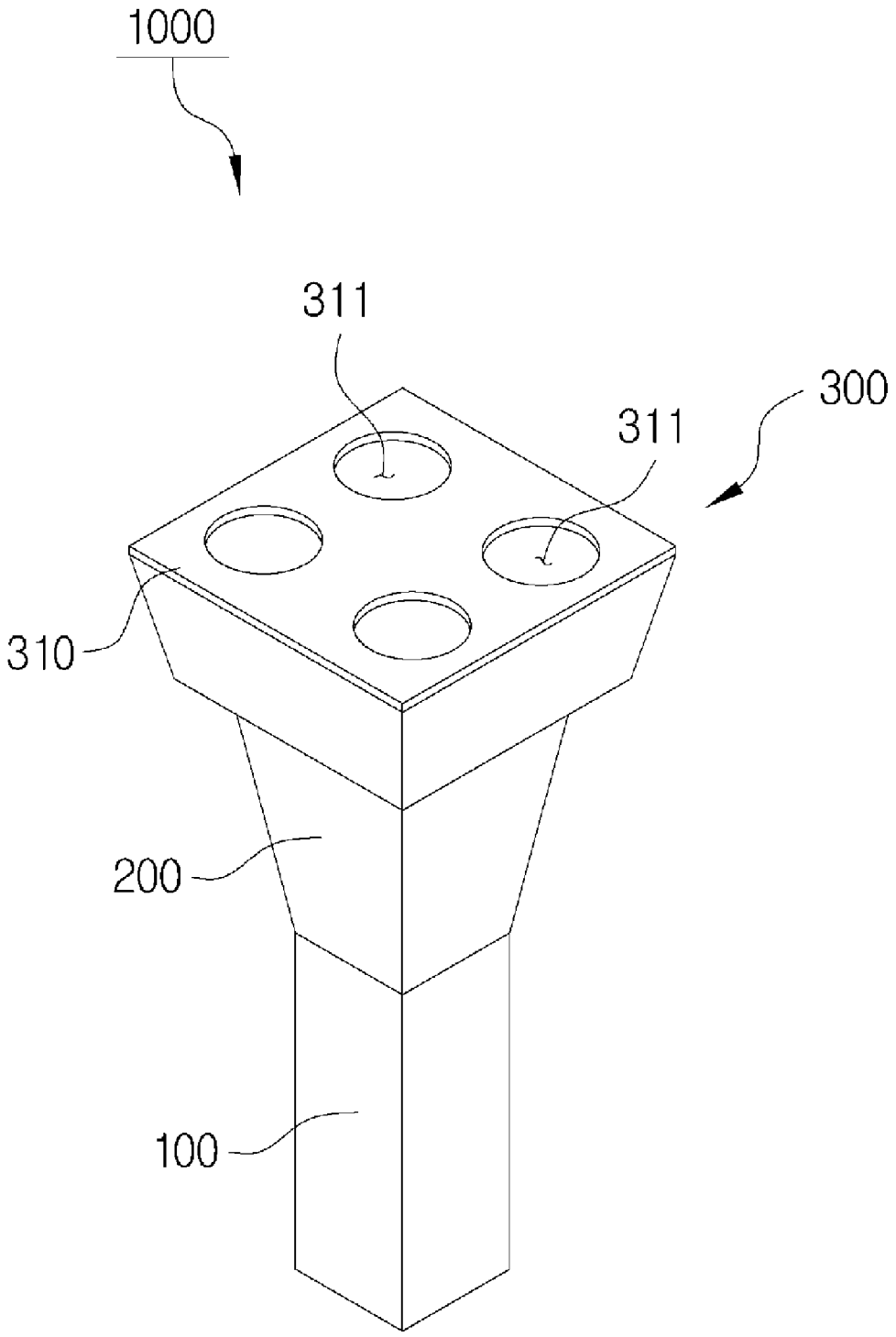
FIG. 2 is a perspective view illustrating a planar horn array antenna according to an exemplary embodiment of the present invention.
Figure 3:
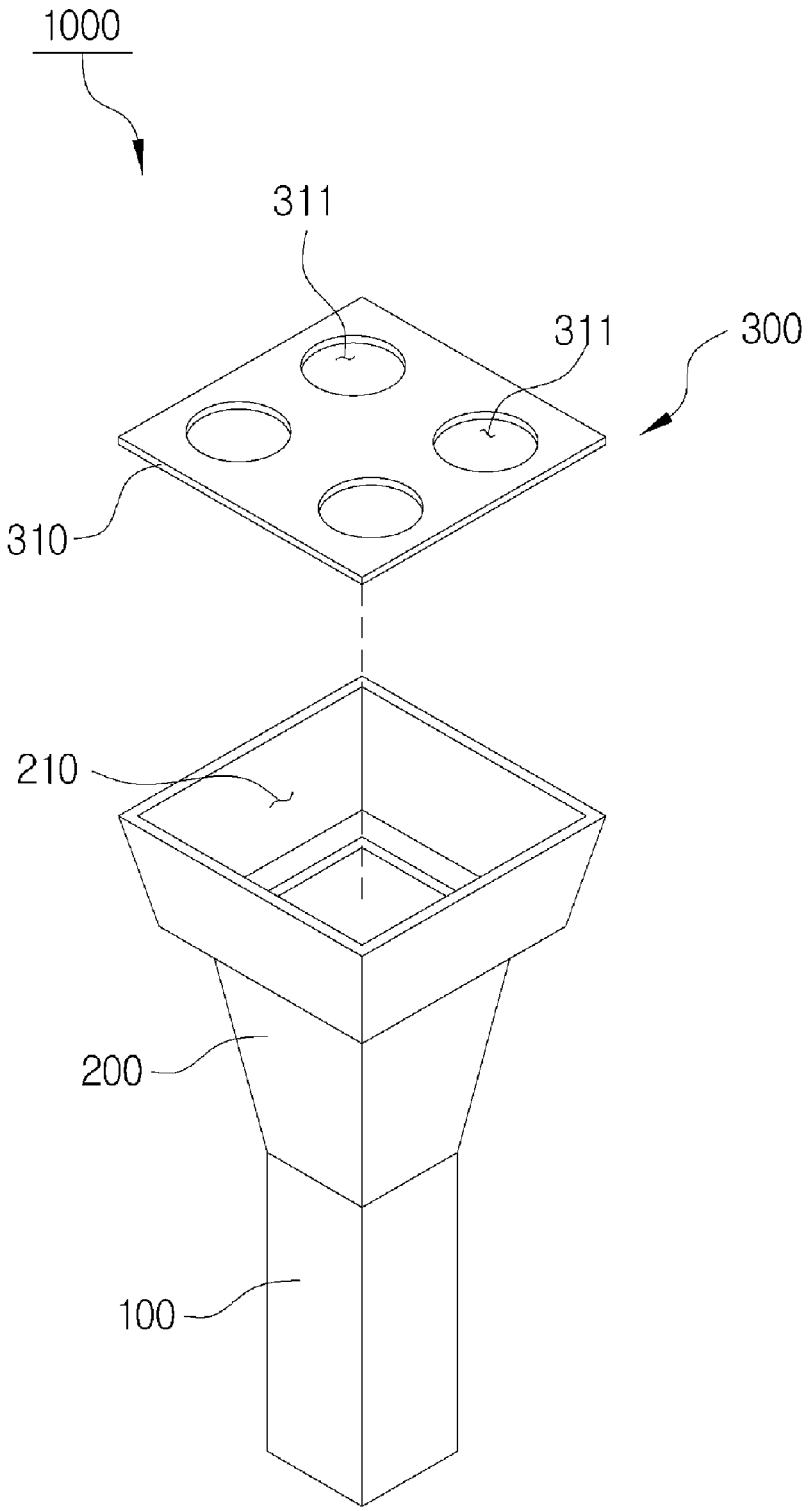
FIG. 3 is an exploded perspective view illustrating the planar horn array antenna according to the exemplary embodiment of the present invention.

FIG. 2 is a perspective view illustrating a planar horn array antenna according to an exemplary embodiment of the present invention and FIG. 3 is an exploded perspective view illustrating the planar horn array antenna according to the exemplary embodiment of the present invention.

As illustrated in FIGS. 2 and 3, a planar horn array antenna 1000 according to an exemplary embodiment of the present invention is configured to include a waveguide part 100, a horn part 200, and a radio wave guide part 300.

The waveguide part 100 consists of a conductor of which the inside is hollow and may serve to transmit a radio wave while the radio wave being reflected between inner walls thereof.

The horn part 200 is a radiating element having a radio wave incident or emitted thereto and has one side connected to the inside of the waveguide part 100 and the other side formed with an opening 201 for guiding the radio wave incident or emitted from the outside.

Further, the horn part 200 may be formed with a plurality of polarization guides for guiding various forms of polarizations included in the radio wave incident to the opening 201.

Further, the waveguide part 100 and the horn part 200 may be formed in an integrated form by being connected to each other to be simply manufactured.

The radio wave guide part 300 is configured to include a dividing member 310.

The dividing member 310 is coupled with the opening 201 and has circular dividing holes 311 horizontally arranged in the opening 201 in a matrix of n×n to divide the radio wave incident or emitted to the opening 201 into n×n. In this case, the dividing member 310 may be coupled with an edge of the opening 201 by silicon or an adhesive.

Further, the dividing member 310 may be formed of a metal conductor material and a predetermined area of the dividing member 310 may be etched in a matrix of n×n to form the dividing holes 311. However, the present invention is not limited thereto.

Figure 4:
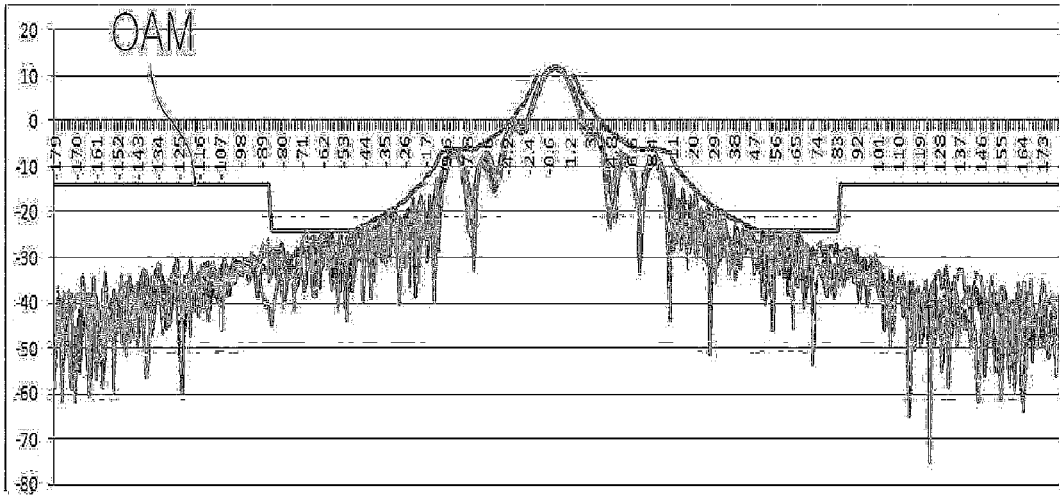
FIG. 4 is a graph illustrating a beam pattern of the planar horn array antenna according to the exemplary embodiment of the present invention.

FIG. 4 is a graph illustrating a beam pattern of the planar horn array antenna according to the exemplary embodiment of the present invention.

As illustrated in FIG. 4, in the planar horn array antenna 1000 according to the exemplary embodiment of the present invention, the radio wave incident or emitted to the opening 201 is divided into n×n to prevent the beam pattern of the radio wave from being beyond an off-axis mask (OAM).

That is, the planar horn array antenna 1000 according to the exemplary embodiment of the present invention includes: the waveguide part 100; the horn part 200 having one side connected to the waveguide part 100 and the other side formed with the opening 201 for guiding the radio wave incident or emitted thereto; and the radio wave guide part 300 having the dividing member 310 coupled with the opening 201 and consisting of the circular dividing holes 311 arranged in the matrix of n×n, such that the radio wave incident or emitted to the opening 201 may be divided into n×n by the dividing holes 311 to minimize the occurrence of the grating lobe.

In particular, in the planar horn array antenna 1000 according to the exemplary embodiment of the present invention, the radio wave incident or emitted to the opening 201 is divided into n×n by the dividing holes 311, thereby minimizing the occurrence of a side lobe radiated while departing from a direction in which the radio wave is directed.

Meanwhile, the dividing hole 311 may be formed in the dividing member 310 in a matrix of 2×2 to 4×4. However, as the number of dividing holes 311 is increased, the radio wave incident or emitted to the opening 201 is divided into a large number, and therefore the occurrence of the grating lobe may be reduced but the strength of the radio wave may be reduced and as the number of dividing holes 311 is reduced, the radio wave incident or emitted to the opening 201 is divided into a small number, and therefore the occurrence of the grating lobe of the radio wave may be increased but the strength of the radio wave may be increased. Therefore, the dividing hole 311 may preferably be formed in the number as described above.

Further, when a wavelength of the radio wave incident or emitted to the dividing holes 311 in the dividing member 310 is λ, an inner diameter of the dividing hole 311 may be formed to be equal to or less than 1λ. In this case, λ=f/c (f=wavelength and c=light velocity).

In this case, when a diameter of the dividing hole 311 is equal to or more than 1λ, the antenna efficiency of the planar horn array antenna 1000 is reduced and the size of the grating lobe is increased, while an array interval of the planar horn array antenna 1000 is expanded. Therefore, the dividing hole 311 may be preferably limited as described above.

Figure 5:
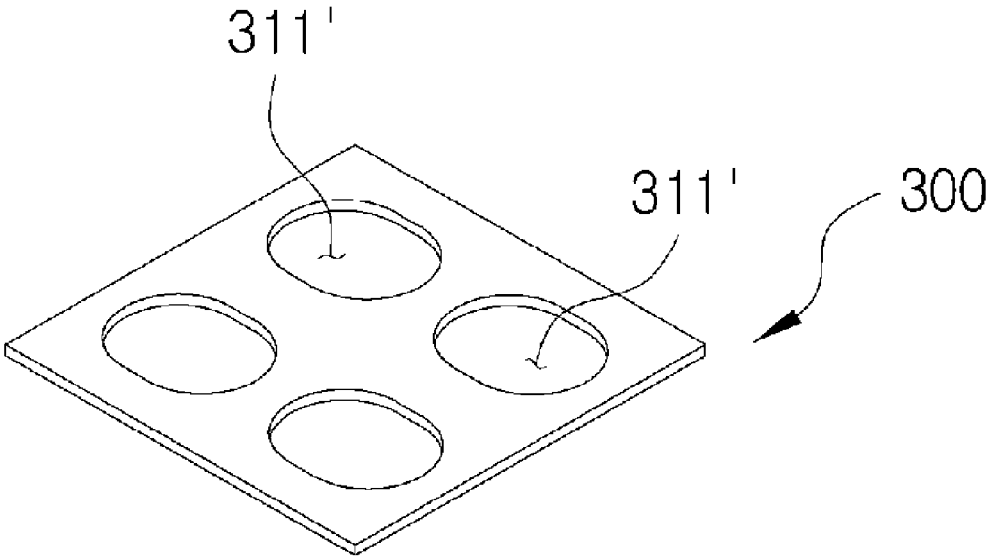
FIG. 5 is a perspective view of a dividing hole according to an exemplary embodiment of the present invention.

FIG. 5 is a perspective view of the dividing hole according to the exemplary embodiment of the present invention.

As illustrated in FIG. 5, a dividing hole 311' according to the exemplary embodiment of the present invention is formed in an elliptical shape.

Figure 6:
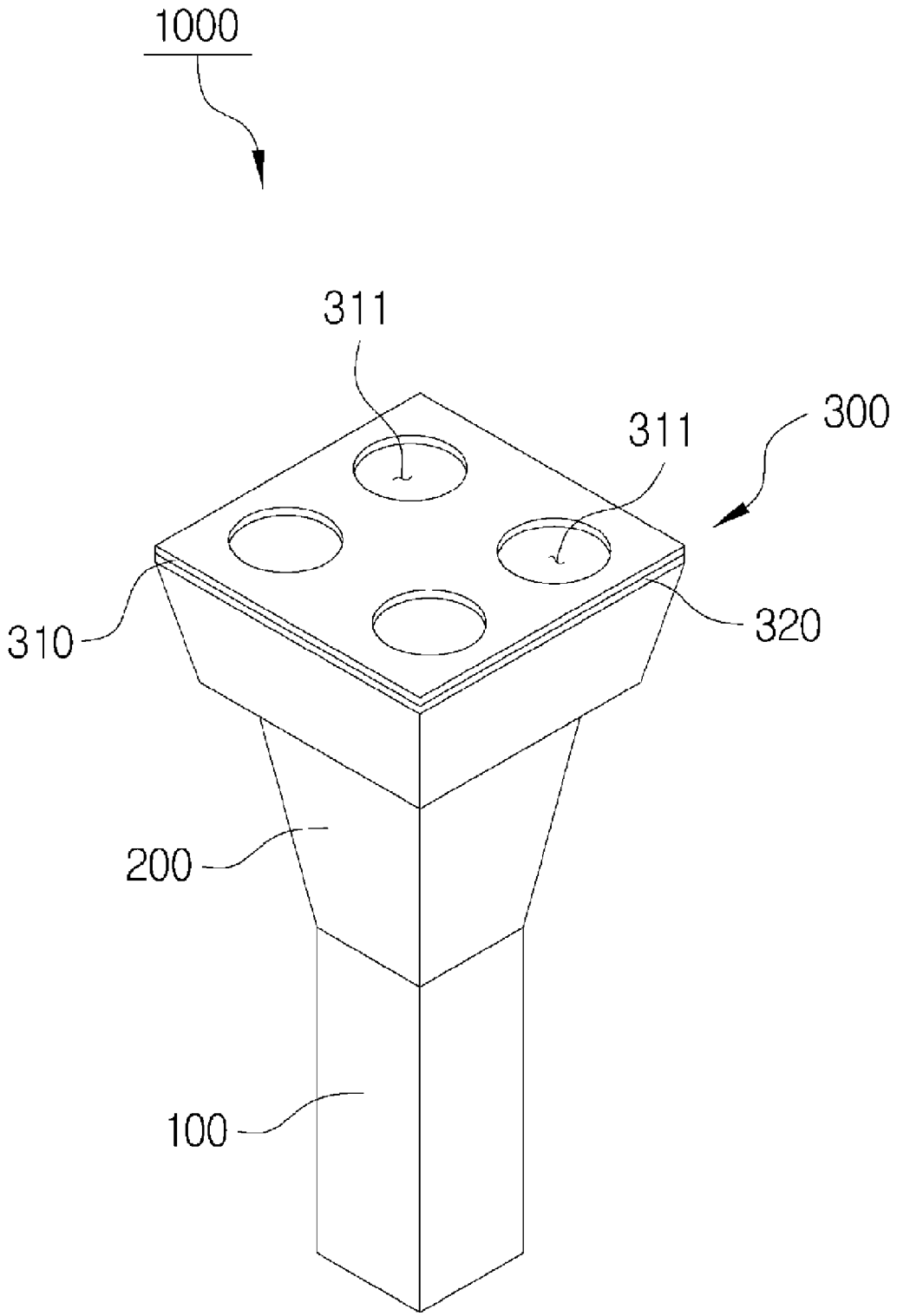
FIG. 6 is a perspective view of a radio wave guide part according to Embodiment 1 of the present invention.
Figure 7:
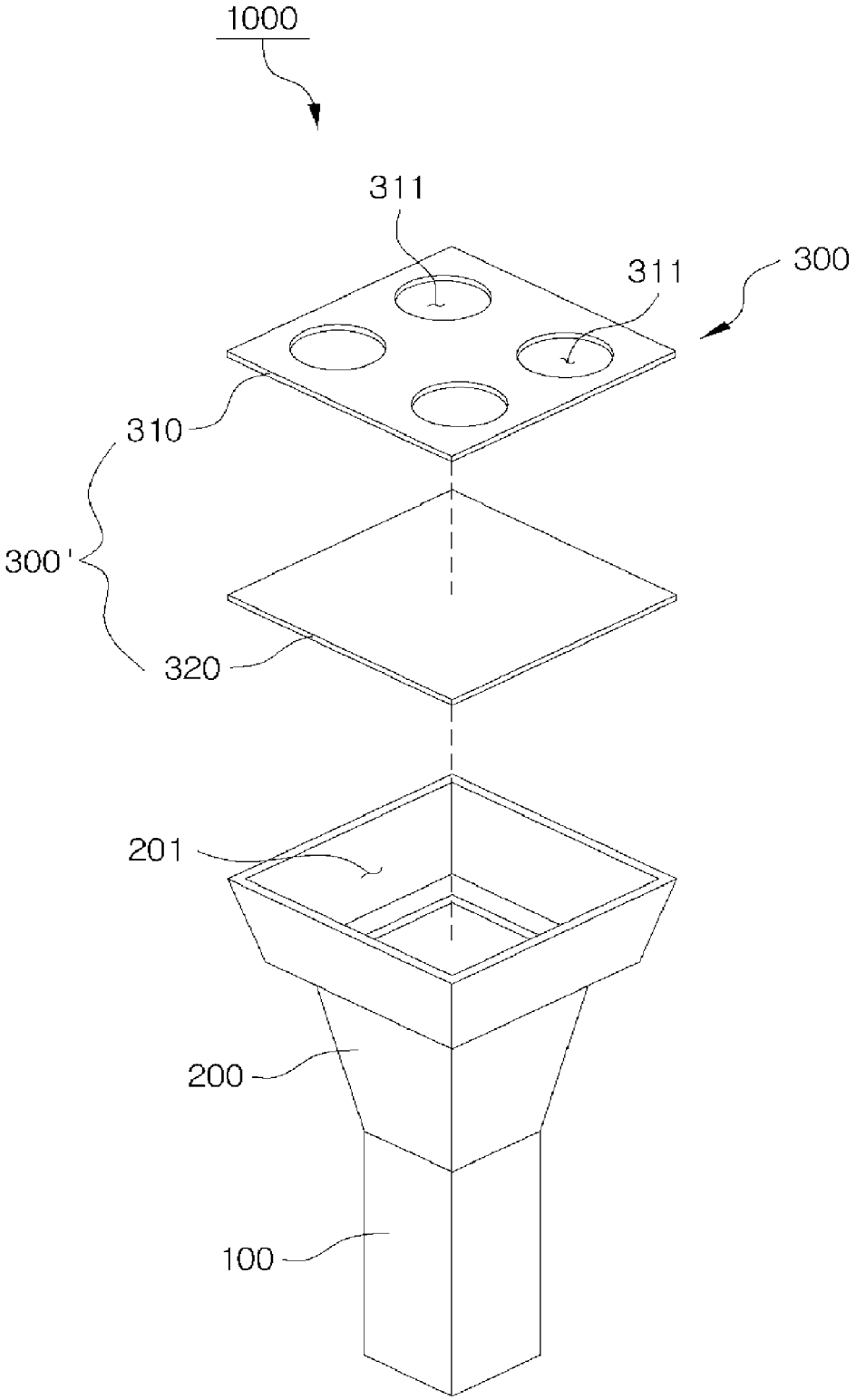
FIG. 7 is an exploded perspective view of the radio wave guide part according to Embodiment 1 of the present invention.

FIG. 6 is a perspective view of the radio wave guide part according to Embodiment 1 of the present invention and FIG. 7 is an exploded perspective view of the radio wave guide part according to Embodiment 1 of the present invention.

As illustrated in FIGS. 6 and 7, a radio wave guide part 300' according to Embodiment 1 of the present invention is configured to further include a cover member 320 coupled between the opening 201 and the dividing member 310.

The cover member 320 is formed of a film type material through which the radio wave incident or emitted to the opening 201 may pass and may have one side coupled with the opening 201 by silicon or an adhesive and the other side coated with the dividing member 310.

Further, in the radio wave guide part 300' according to Embodiment 1 of the present invention, one side of the cover member 320 is coated with the dividing member 310, a predetermined area of the dividing member 310 is etched to form the dividing holes 311, and the other side of the cover member 320 may be coupled with the opening 201.

Further, when the wavelength of the radio wave incident or emitted to the dividing holes 311 is λ, the thickness of the cover member 320 between the opening 201 and the dividing member 310 is formed to be equal to or less than λ/2.

The thickness of the cover member 320 between the opening 201 and the dividing member 310 is associated with impedance matching of the antenna and the poor impedance matching of the antenna means that an antenna gain is reduced, that is, antenna performance is reduced.

Therefore, in the radio wave guide part 300' according to Embodiment 1 of the present invention, the thickness of the cover member 320 between the opening 201 and the dividing member 310 is formed to be equal to or less than λ/2, such that the waveguide horn antenna gain may not be reduced.

Figure 8:
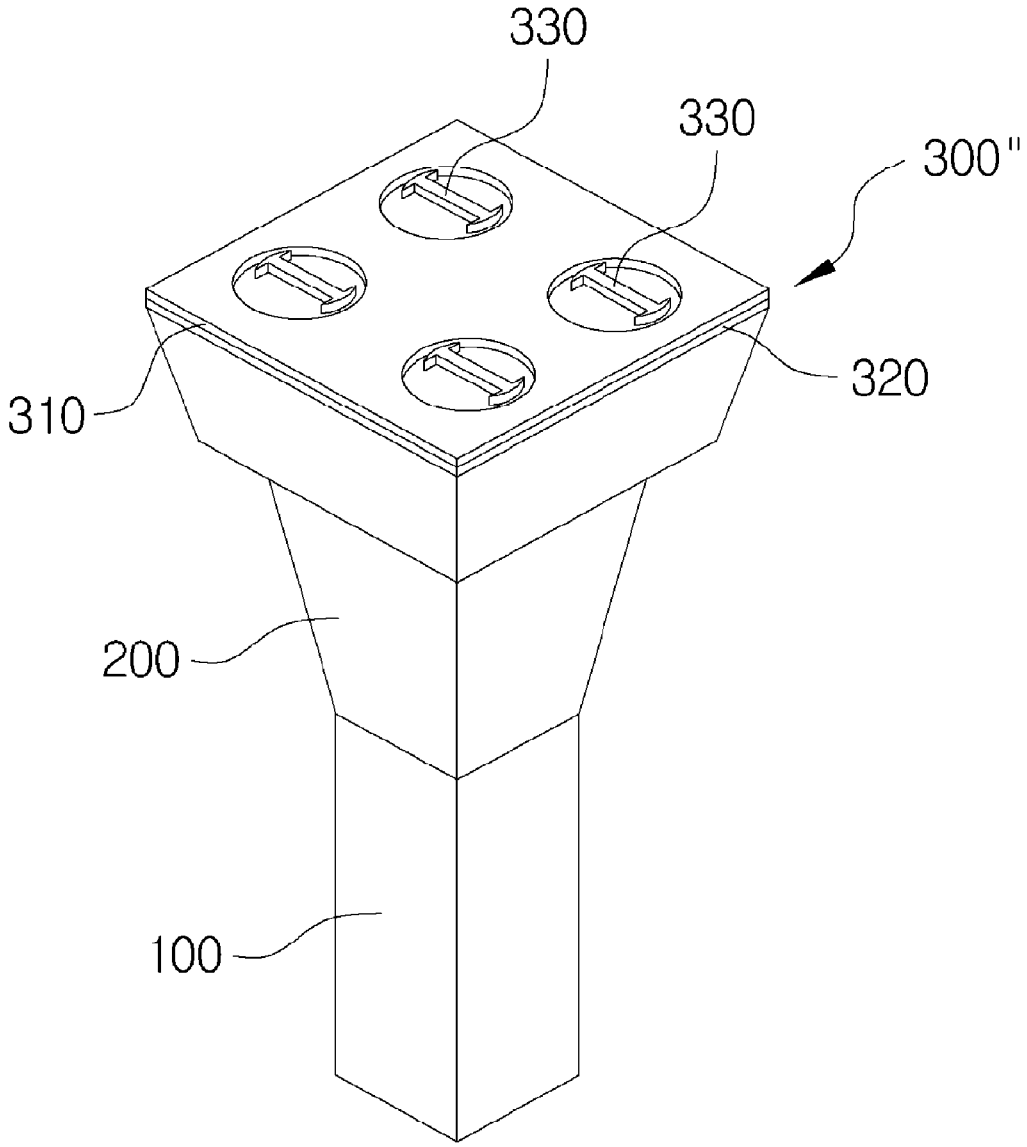
FIG. 8 is a perspective view of a radio wave guide part according to Embodiment 2 of the present invention.

FIG. 8 is a perspective view of a radio wave guide part according to Embodiment 2 of the present invention.

As illustrated in FIG. 8, a radio wave guide part 300" according to Embodiment 2 of the present invention is configured to further include polarizer members 330 which are disposed in the dividing holes 311 and coupled with the cover member 320.

The polarizer member 330 is formed of the same material as the dividing member 310 and serves to control the angle of the radio wave incident or emitted to the dividing holes 311.

Therefore, the planar horn array antenna 1000 according to the exemplary embodiment of the present invention is configured to further include the polarizer members 330 which are disposed in the dividing holes 311 and coupled with the cover member 320 to control the angle of the radio wave incident or emitted to the dividing holes 311, thereby controlling the skew angle without mechanically rotating the planar horn array antenna 1000.

Meanwhile, the polarizer member 330 may be configured of a first body formed in an H shape, that is, a plate shape and a pair of second bodies each formed in a bell shape and coupled with both ends of the first body.

Figure 9:
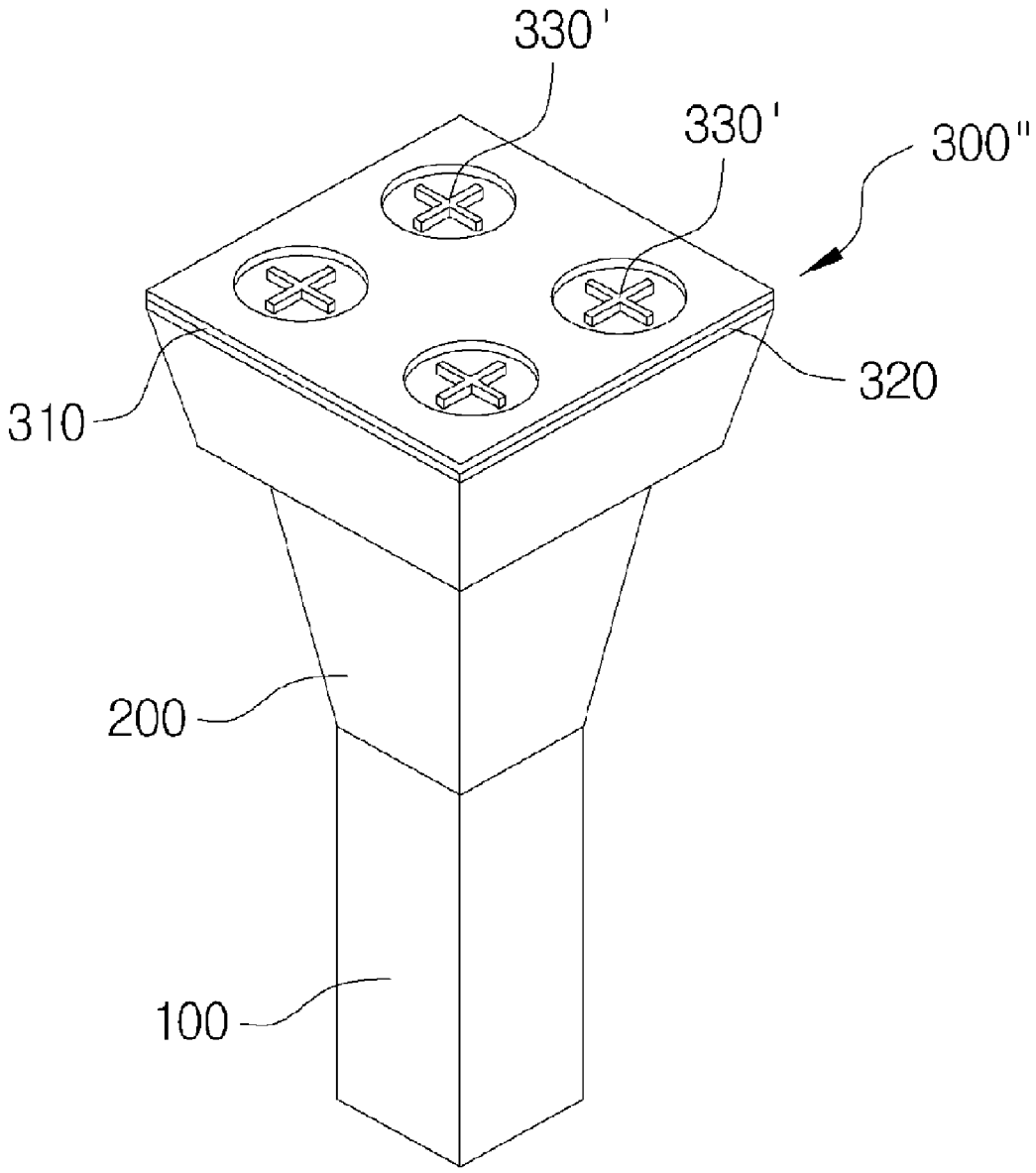
FIG. 9 is a perspective view of a polarizer member illustrated in FIG. 8 according to Embodiment 1 of the present invention.
Figure 10:
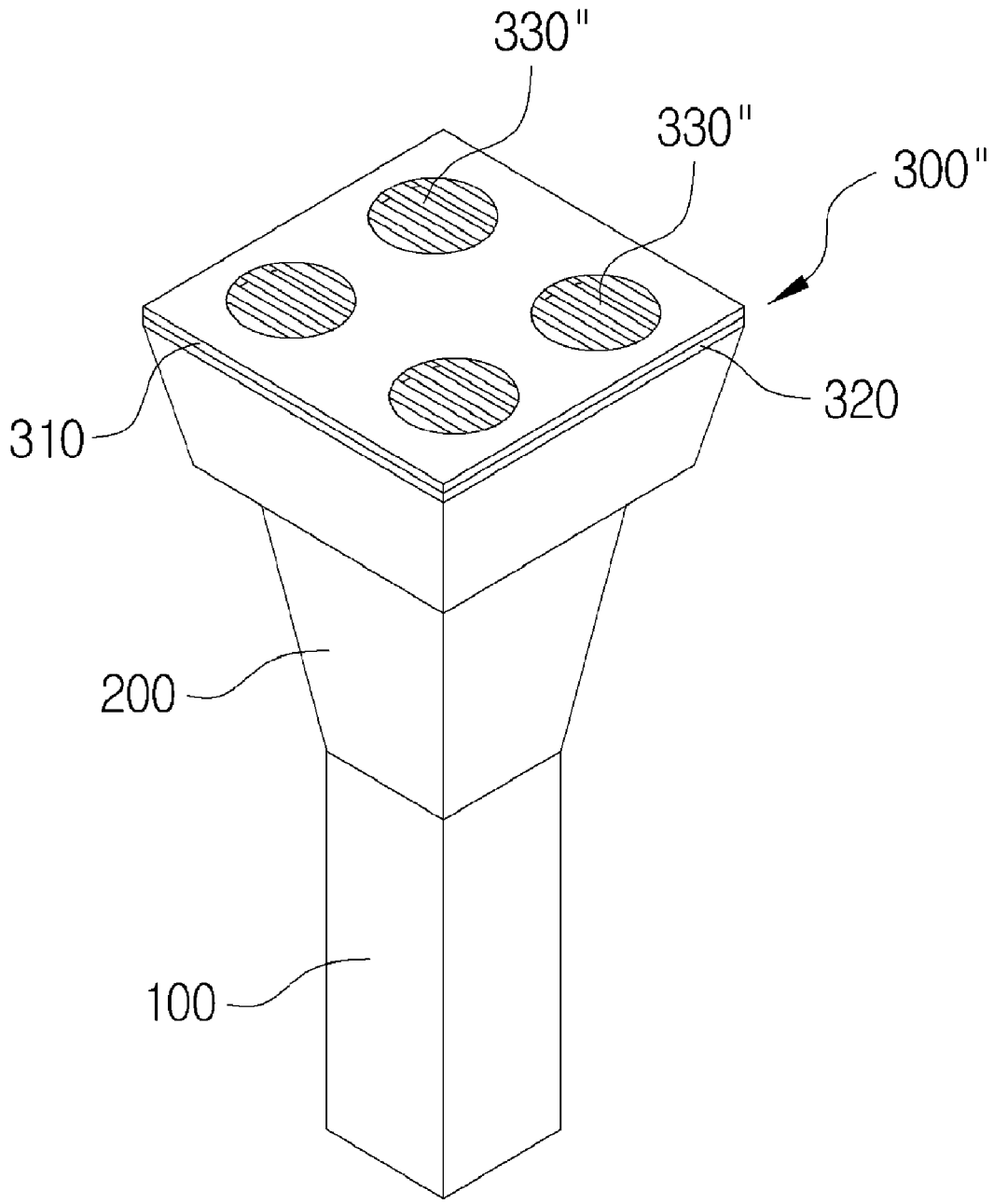
FIG. 10 is a perspective view of the polarizer member illustrated in FIG. 8 according to Embodiment 2.

FIG. 9 is a perspective view of the polarizer member illustrated in FIG. 8 according to Embodiment 1 of the present invention and FIG. 10 is a perspective view of the polarizer member illustrated in FIG. 8 according to Embodiment 2 of the present invention.

As illustrated in FIG. 9, Embodiment 1 of the polarizer member 330' illustrated in FIG. 8 may be formed in a cross shape.

As illustrated in FIG. 10, Embodiment 2 of the polarizer member 330" illustrated in FIG. 9 may be formed in a comb shape.

The present invention is not limited to the above-mentioned exemplary embodiments, and may be variously applied, and may be variously modified without departing from the gist of the present invention claimed in the claims.

DETAILED DESCRIPTION OF MAIN ELEMENTS

1000: Planar horn array antenna according to the invention
100: Waveguide part
200: Horn part
201, 201': Opening
300, 300', 300": Radio wave guide part
310: Dividing member
311: Dividing hole
320: Cover member
330, 330', 330": Polarizer member

The invention claimed is:

1. A planar horn array antenna, comprising:

a waveguide part;

a horn part having one side connected to the waveguide part and the other side formed with an opening for guiding a radio wave incident or emitted thereto; and a radio wave guide part having a dividing member coupled with the opening, the dividing member comprising circular dividing holes arranged in a matrix of n×n, the radio wave guide part further having a cover member coupled between the opening and the dividing member to cover the opening, wherein in the cover member, when a wavelength of a radio wave incident or emitted to the dividing holes is λ, a thickness of the cover member between the opening and the dividing member is formed to be equal to or less than λ/2.

2. The planar horn array antenna of claim 1, wherein in the dividing member, when a wavelength of a radio wave incident or emitted to the dividing holes is λ, an inner diameter of each dividing hole is formed to be equal to or less than 1λ.

3. The planar horn array antenna of claim 1, wherein in the dividing member, each dividing hole is formed in an elliptical shape.

4. The planar horn array antenna of claim 1, wherein the radio wave guide part further includes one or more polarizer members, wherein each polarizer member is disposed in one of the dividing holes and is coupled with the cover member to control an angle of the radio wave incident or emitted to the dividing hole in which it is disposed.

5. The planar horn array antenna of claim 4, wherein each polarizer member is formed in an H shape, a cross shape, or a comb shape.

* * * * *